US006223006B1

(12) United States Patent
Scheuer et al.

(10) Patent No.: US 6,223,006 B1
(45) Date of Patent: Apr. 24, 2001

(54) PHOTORECEPTOR CHARGE CONTROL

(75) Inventors: Mark A. Scheuer, Williamson; Eric M. Gross; Wenjin Zhou, both of Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/451,728

(22) Filed: Dec. 1, 1999

(51) Int. Cl.[7] ..... G03G 15/00
(52) U.S. Cl. ..... 399/48
(58) Field of Search ..... 399/31, 38, 46, 399/48, 50, 159, 162, 168

(56) References Cited

U.S. PATENT DOCUMENTS 4,647,184 * 3/1987 Russell et al. ..... 399/48
4,724,461 * 2/1988 Rushing ..... 399/48
5,291,245 * 3/1994 Charnitski et al. ..... 399/162 X
5,832,333 * 11/1998 Umeda et al. ..... 399/48

FOREIGN PATENT DOCUMENTS

01109365 * 4/1989 (JP) .

* cited by examiner

*Primary Examiner*—Sandra Brase

(57) ABSTRACT

Photoreceptor charge control for obviating the adverse effects of photoreceptor variation inherent in the photoreceptor as the result of the manufacturing process. The voltage values around the periphery of the photoreceptor commonly referred to as the $V_c$ belt signature are measured. The readings for each of the ESVs are averaged (to find the mean) and the deviations from the mean are smoothed using a 41-term weighting function that properly removes the high frequency reading spikes while retaining the low frequency belt signature. Center weighted averaging of 41 points (n, . . . n±20) where n is a measured point on the photoreceptor that is averaged with the previous twenty readings together with the next twenty readings is initiated a few mm past the photoreceptor seam and ends a few mm before the seam—no phase shift. The readings are taken approximately every 3 mm around the periphery of the photoreceptor.

20 Claims, 5 Drawing Sheets

PHOTORECEPTOR CHARGE CONTROL

BACKGROUND OF THE INVENTION

This invention relates to color imaging processors and, in particular, to photoreceptor charge control that obviates the adverse effects of photoreceptor variation inherent in the photoreceptor as the result of the manufacturing process.

Many xerographic copiers and printers maintain the charge level on the photoreceptor via feedback control by sampling the resultant charge using an electrostatic voltmeter. These InterDocument or InterPage Zone (IDZ or IPZ) readings are taken around the photoreceptor. Many photoreceptors are known to have a once-around variation in the charge level, due primarily to dielectric thickness variations commonly referred to as run-out.

Charge control was first performed in the Xerox 1075™ by examining the density of lightly developed images with a reflective infrared densitometer. These images were sensitive to both development field and toner concentration (the latter being controlled by examining a higher density patch). In subsequent Xerox™ machines (1065™, 5090™, 5100™, 4890™, 5775™) one or more compact Electrostatic Voltmeters (ESV) were used to directly sense the charge levels on the photoreceptor. In each of these machines, images or test patches are placed on the photoreceptor in small regions between customer's prints, such regions being commonly known as IDZs or IPZs. The charge level of such an image is read by the ESV. These readings, sometimes filtered, are compared to a pre-established charge target and adjustments are made to the charging system to bring the readings to target. Because these readings are taken at various points around the photoreceptor, any circumferential variation in the photoreceptor charge level can affect the readings. A typical source of variation is dielectric thickness changes, established during the photoreceptor manufacturing due to run-out in the coating rolls employed to fabricate the photoreceptor. In some photoreceptors this noise can exceed an unacceptable peak-to-peak amplitude of 30 volts.

Some photoreceptors are known to possess a repeatable once-around profile but the amplitude is only about 5–10 volts. This level is at a "just noticeable difference" in color error (delta $E_{cmc}$) and correction of this once-around profile is not necessary. Nor is it practicable due to the broad expanse of the charging zone that is much larger than the structure of the voltage variations.

However, it is still desirable to characterize and correct the charge readings for this variation. This will prevent the charge level from riding this profile as the charge level is maintained, thereby minimizing overall variation in the photoreceptor charge level. Uncorrected voltages will follow the once-around voltage profile of the photoreceptor and cause the average charge level to change. Corrected voltages that cause the average charge level of the photoreceptor to remain constant are quite desirable.

BRIEF SUMMARY OF THE INVENTION

The purposes and intents of the present invention are effected by correcting the voltages that cause the average charge level of the photoreceptor to change so that the charge level remains constant instead of following the once-around voltage profile of the photoreceptor. The forgoing is implemented by reading or measuring the once-around belt signature or voltage profile, Vcharge of the photoreceptor using five ESVs, corresponding to five image separations during a machine setup routine in which the charge output level remains constant. The readings for each of the ESVs are averaged (to find the mean) and the deviations from the mean are smoothed using a 41-term weighting function that properly removes the high frequency reading spikes while retaining the low frequency belt signature. Center weighted averaging of 41 points (n, . . . n±20) where n is a measured point on the photoreceptor that is averaged with the previous twenty readings together with the next twenty readings is initiated a few mm past the photoreceptor seam and ends a few mm before the seam. This insures that no phase shift occurs between the sensor reading position and the filtered correction. The readings are taken approximately every 3 mm around the photoreceptor.

The ESVs, one each for spot color (S), black (K), yellow (Y), magenta (M), and cyan (C) mounted on the respective developer housings and are positioned at five different locations across the width (i.e. direction perpendicular to that of photoreceptor movement) of the photoreceptor to produce a voltage profile characterization that more closely reflects the photoreceptor run-out.

Following is a discussion of prior art, incorporated herein by reference, that may bear on the patentability of the present invention. In addition to possibly having some relevance to the question of patentability, these references, together with the detailed description to follow, may provide a better understanding and appreciation of the present invention.

U.S. Pat. No. 5,864,730 granted to Budnik et al on Jan. 26, 1999 relates to a method to provide a highly intelligent automated diagnostic system that identifies the need to replace specific parts to minimize machine downtime rather than require extensive service troubleshooting. In particular, a systematic, logical test analysis scheme to assess machine operation from a simple sensor system and to be able to pinpoint parts and components needing replacement is provided by a series of first level of tests by the control to monitor components for receiving a first level of data and by a series of second level of tests by the control to monitor components for receiving a second level of data. Each of the first level tests and first level data is capable of identifying a first level of part failure independent of any other test. Each of the second level tests and second level data is a combination of first level tests and first level data or a combination of a first level test and first level data and a third level test and third level data. The second level tests and second level data are capable of identifying second and third levels of part failure. Codes are stored and displayed to manifest specific part failures.

U.S. Pat. No. 5,963,761 granted to Budnik et al on Oct. 5, 1999 relates area coverage sensor calibration and algorithm for seam detection noise eliminator on a seamed photoreceptor. The invention disclose an apparatus and method for eliminating random noise and calibrating a seam detection sensor in an electrophotographic printing machine. When the detected centerline remains within the tolerance window the algorithm proceeds as normal. In most cases, however, the center line is shifted outside the tolerance window., either from 2 to −X or +X to N−1. When the centerline falls within either of these two ranges, the algorithm recognizes this fact and assumes that a random noise condition has occurred. It then proceeds to take the previous centerline (C) and add the current photoreceptor belt length to it. This, theoretically, should be exactly where the centerline should have been in the absence of noise. If this condition continues for three successive belt revolutions and the machine completes the job it was running, the algorithm will force the machine to search for the seam at the next cycle up. If the centerline is calculated to be at position 1 or N, the algorithm assumes some drastic change has occurred and an immediate fault is declared. To calibrate the sensor, the calibration algorithm increases the duration of each calibration pulse to 80 ms, and two reads per pulse are instituted. The algorithm then chooses the greater of the two reads on each individual step, thus eliminating any read of the seam that might adversely affect the calibration scheme.

U.S. Pat. No. 5,893,008 granted to Budnik et al on Apr. 6, 1999 discloses a photoreceptor parking deletion including method to provide a highly intelligent, automated diagnostic system that identifies the need to replace specific parts to minimize machine downtime rather than require extensive service troubleshooting. In particular, a systematic, logical test analysis scheme to assess machine operation from a simple sensor system and to be able to pinpoint parts and components needing replacement is provided by a series of first level of tests by the control to monitor components for receiving a first level of data and by a series of second level of tests by the control to monitor components for receiving a second level of data. Each of the first level tests and first level data is capable of identifying a first level of part failure independent of any other test. Each of the second level tests and second level data is a combination of first level tests and first level data or a combination of a first level test and first level data and a third level test and third level data. The second level tests and second level data are capable of identifying second and third levels of part failure. Codes are stored and displayed to manifest specific part failures.

U.S. Pat. No. 5,887,221 granted to Robert E. Grace on Mar. 23, 1999 discloses signature sensing for optimum toner control with donor roll. Reload characteristics of a development member such as a donor roll are monitored by using a machine exposure system (ROS or LED Bar) to generate a test image composed of a short (in the process direction) high density solid area patch followed by a long mid and lower density areas (solid or halftone), the later corresponding to Reload Defect (RD) exhibited by the development member. Typical dimensions of the test image would be a 15 mm square high density patch followed by a 200 times 15 mm mid and lower density regions. This test image voltage profile is placed in a skipped image frame inserted into a long job, or is effected during cycle-out/down following a shorter job run, and is scheduled at infrequent periodic intervals, for example, every 2000 prints. The resultant developed toner pattern on the photoreceptor is monitored, for example, with a reflectance or transmission density sensor such as the Toner Area Coverage (TAC) sensor used in the 4700 TM, 4850 TM, and 5775 TM imaging products or an Extended Toner Area Coverage (ETAC) sensor. The toner dispense rate is adjusted to obtain a desired level of Reload Defect in the developed toner pattern that corresponds to the optimum level of Toner Concentration in the development system.

U.S. Pat. No. 5,777,656 granted to Thomas A. Henderson on Jul. 7, 1998 discloses a tone reproduction maintenance system for an electrostatographic printing machine. As disclosed in this patent, the surface of a photoreceptor shows quite a large variation in smoothness and hence there is a non-uniformity or a signature in the bare drum Optimized Color Densitometers (OCD) readings. Referring to FIG. 5 of this patent, one notes that because of the signature, a 50% halftone patch at one location on the photoreceptor appears to have less toner than the bare drum measured at another location. Clearly, to measure multiple patches on a single page one must account for the signature. Also shown is the fact that as area coverage increases, the signature is obscured, until at about 60% halftone coverage there is no contribution from the signature to the OCD specular measurement. The measurement technique that solves these problems first chooses a point on the signature to act as a reference. Then at any patch location along the signature an offset to the reference can be computed. This, for example, will now equalize the measurements of the bare drum; a 0% patch will have the same reading no matter where on the page it appears. To measure halftones, the approximate area coverage that is known from the pixel value that made the halftone patch is used. With this pixel value, the signature offset can be discounted from the measurement in proportion to the area coverage, up to the 60% limit. Without signature correction the tone curve shows large variability while with correction, the tone curve is stable.

DETAILED DESCRIPTION OF THE PREFERRED EMBODIMENT (S) OF THE INVENTION

Figure 1:
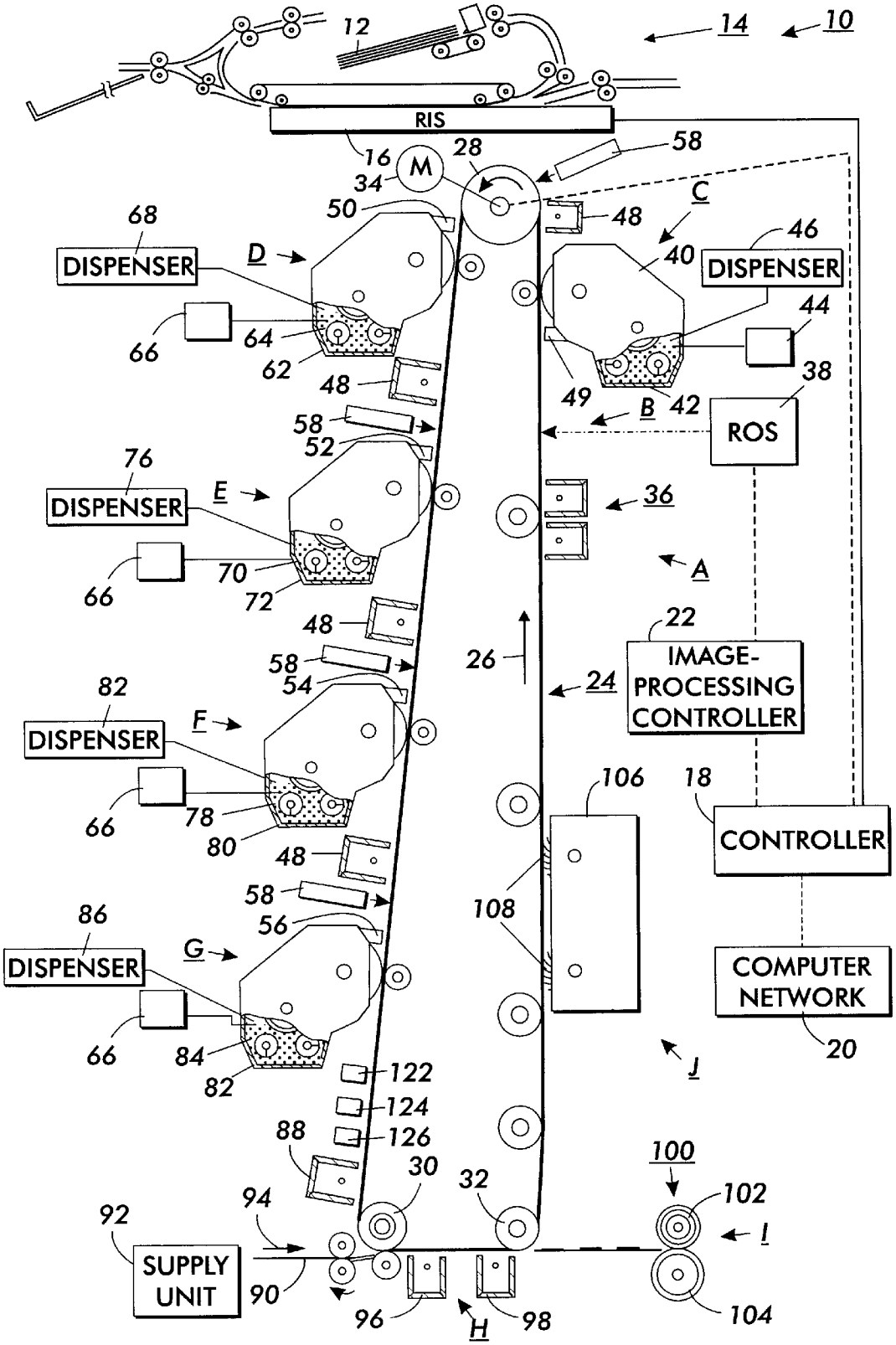
FIG. 1 is a schematic illustration of a xerographic print engine in which the present invention may be utilized.

In one embodiment of the invention, an original document 12 can be positioned in a document handler 14 on a Raster Input Scanner (RIS) indicated generally by reference numeral 16. However, other types of scanners may be substituted for RIS 16. The RIS 16 captures the entire original document and converts it to a series of raster scan lines or image signals. This information is transmitted to an electronic subsystem (ESS) or controller 18. Alternatively, image signals may be supplied by a computer network 20 to controller 18. An image-processing controller 22 receives the document information from the controller 18 and converts this document information into electrical signals for use by a raster output scanner.

The printing machine preferably uses a charge retentive surface in the form of a photoreceptor belt 24 supported for movement in the direction indicated by arrow 26, for advancing sequentially through various xerographic process stations. The photoreceptor belt 24 is entrained about a drive roller 28, tension roller 30, fixed roller 32. The drive roller 28 is operatively connected to a drive motor 34 for effecting movement of the photoreceptor belt 24 through the xerographic stations. In operation, as the photoreceptor belt 24 passes through charging station A, a corona generating arrangement, indicated generally by the reference numeral 36, charges the photoconductive surface of photoreceptor belt 24 to a relatively high, substantially uniform, preferably potential. The corona discharge arrangement preferably comprises an AC scorotron and a DC dichorotron having grid elements to which suitable voltages are applied.

Next, photoconductive surface 24 is advanced through an imaging/exposure station B. As the photoreceptor passes through the imaging/exposure station B, the controller 18 receives image signals representing the desired output image from Raster Input Scanner 16 or computer network 20 and processes these signals to convert them to the various color separations of the image. The desired output image is transmitted to a laser based output scanning device, that causes the uniformly charged surface of the photoreceptor belt 24 to be discharged in accordance with the output from the scanning device. Preferably the laser based scanning device is a laser Raster Output Scanner (ROS) 38. Alternatively, the ROS 38 could be replaced by other xerographic exposure devices such as an LED array.

The photoreceptor belt 24, that is initially charged to a voltage $V_0$, undergoes dark decay to a level equal to about −500 volts. When exposed at the exposure station B, it is discharged to a residual voltage level equal to about −50 volts. Thus after exposure, the photoreceptor belt 24 contains a monopolar voltage profile of high and low voltages, the former corresponding to charged areas and the latter corresponding to discharged areas. The high voltage portions of the photoreceptor are background areas that undergo no development while the low voltage portions are developed using Discharged Area Development.

At a first development station C where a first separation image is developed a first development station C comprising any type of development system even a magnetic brush development system may be used. Preferably a hybrid scavengeless development system including a developer structure 40 is utilized. A hybrid scavengeless development system provides the ability to develop downstream toners without scavenging toners already placed on the photoreceptor by the development of upstream image separations. As will be appreciated, the use of a scavengeless development system at the first development station is not necessary because it doesn't interact with an already developed image as do subsequent development structures.

Hybrid scavengeless development is used in development stations subsequent to station C to avoid interactions with a previously developed image. A hybrid scavengeless development system utilizes a standard magnetic brush development system to place charged toner on two donor rolls. A set of wires is located between the donor rolls and the photoreceptor. AC and DC fields are established on the donor and wires to create a powder cloud of toner near the photoreceptor. The frequency of the AC is set to prevent toner in the cloud from touching the photoreceptor. Instead, the image fields on the photoreceptor reach into the powder cloud and attract the toner out of the cloud. This arrangement is highly successful in preventing scavenging of previously developed toner images. For a more detailed description of a scavengeless development system, reference may be had to U.S. Pat. No. 5,144,371 granted to Dan Hays on Sep. 1, 1992.

The developer structure 40 contains, for example, magenta toner particles 42. The powder cloud causes charged magenta toner particles 42 to be attracted to the electrostatic latent image. Appropriate developer biasing is accomplished via a power supply (not shown). This type of development system is a hybrid scavengless type in which only toner particles (magenta, for example) are attracted to the latent image and there is no mechanical contact between the photoreceptor belt 24 and the toner delivery device that would disturb a previously developed, but unfixed, image. A toner concentration sensor 44 senses the toner concentration in the developer structure 40. A dispenser 46 dispenses magenta toner into the developer structure 40 to maintain a proper toner concentration. The dispenser 46 is controlled via controller 18.

The developed but unfixed or non-fused image is then transported past a second charging device 48 where the photoreceptor belt 24 carrying the previously developed magenta toner image areas is recharged to a predetermined level. The charging device 48 comprises a split recharge system, wherein both a direct and an alternating current charging device, are used. While disclosed in the drawing as a single member the split charge arrangement actually comprises separate components for effecting the DC and AC functionality. Split recharging ensures uniform charge areas on the photoreceptor, independent of previously developed toner images. The split recharge system requires that the electrostatic controls for each separation be maintained within the confines of the charge, expose, and develop steps within the image separations. For a more detailed description of a split recharge system, reference may be had to U.S. Pat. No. 5,600,430 granted on Feb. 4, 1997 to Folkins et al.

Figure 5:
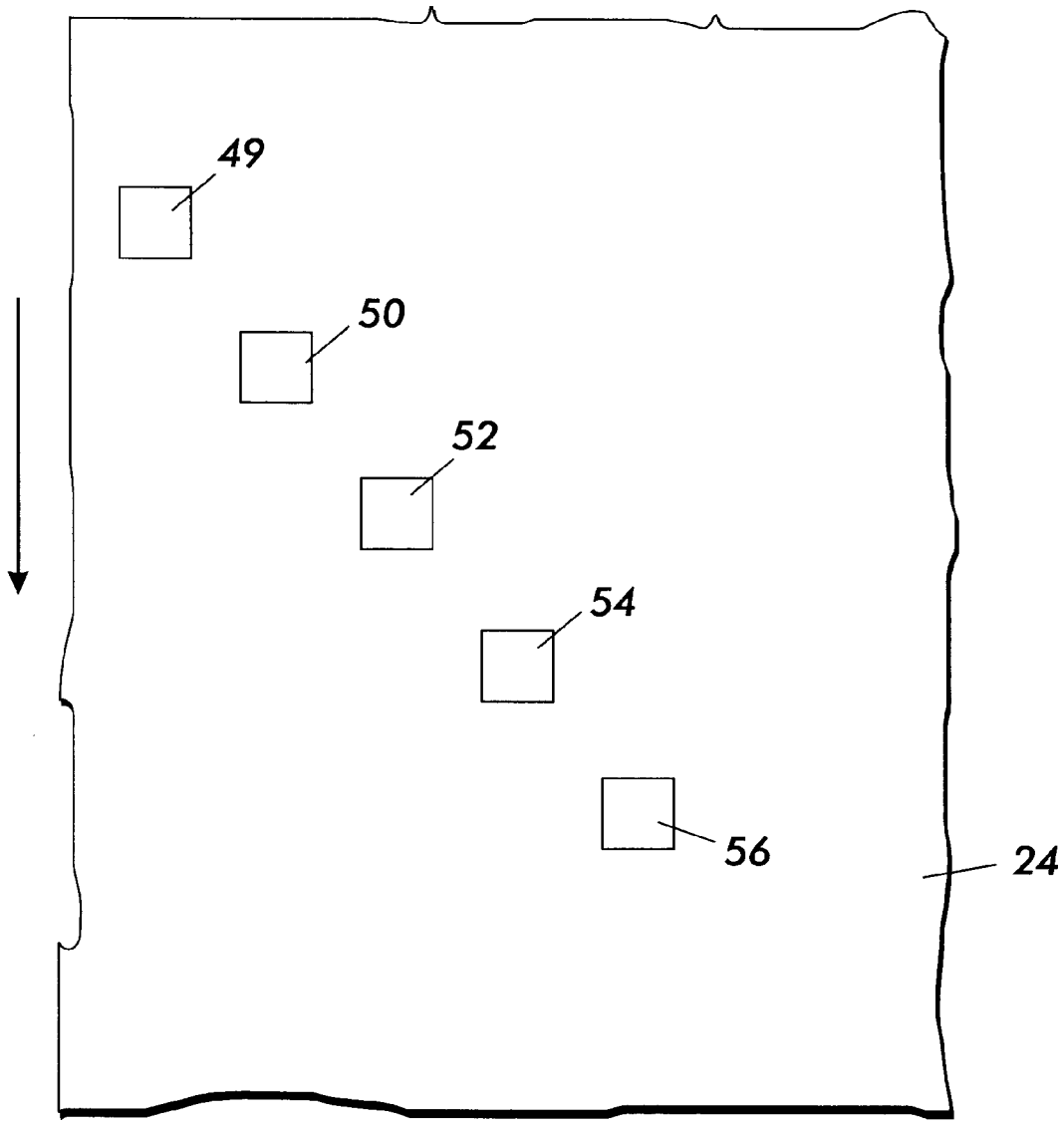
FIG. 5 is schematic illustration of the positioning of five ESVs relative to a photoreceptor.

Five separate ESVs, 49, 50, 52, 54 and 56 are employed for monitoring both charge and exposure voltages. There is one ESV for each development housing structure. Each ESV is mounted on the upstream side of the developer housing structure with which it is associated such that they sense, for one purpose, photoreceptor voltages prior to image development. The ESVs monitor the exposed voltages but do not directly control them. The ESV 49 is mounted on one end of the developer housing structure 40 in a position that is intermediate the ROS 38 and a developer roll forming a part of that housing structure. As illustrated in FIG. 5, the positions of the ESVs are staggered relative to photoreceptor such that they extend across the width of the photoreceptor as it moves in a continuous path through the various process stations of this machine.

A second exposure/imaging is performed by a device 58 preferably comprising a laser based output structure. The device 58 is utilized for selectively discharging the photoreceptor belt 24 on toned and/or untoned image areas of the photoreceptor 24, in accordance with the image information being processed. Device 58 may be a Raster Output Scanner or LED bar, that is controlled by controller 18 or network computer 20. At this point, the photoreceptor belt 24 may contain toned and untoned image areas at relatively high voltage levels and toned and untoned areas at relatively low voltage levels. Low voltage areas represent image areas that will be developed using Discharged Area Development (DAD) while high voltage areas remain untoned. A suitably charged, developer material 64 comprising the second color toner, preferably yellow, is employed. The second color toner is contained in a developer structure 62 disposed at a second developer station D and is presented to the latent electrostatic images on the photoreceptor belt 24 by way of a second developer system. A power supply (not shown) serves to electrically bias the developer structure 62 to a level effective to develop the appropriate image areas with charged yellow toner particles 64. Further, a toner concentration sensor 66 senses the toner concentration in the developer structure 62. A toner dispenser 68 dispenses yellow toner into the developer structure 62 to maintain a proper toner concentration. The dispenser 68 is controlled via controller 18.

The above procedure is repeated for a third image for a third suitable color toner such as cyan 70 contained in developer structure 72 (station E), and for a fourth image and suitable color toner such as black 78 contained in a developer structure (station F). Toner dispensers 76 and 82 serve to replenish their respective development systems.

A fifth imaging station G is provided with a developer structure 82 containing a spot toner 84 of any suitable color for use in extending the color gamut of this image processor. Toner replenishment is effected using a toner dispenser 86.

Preferably, developer systems 42, 62, 72, 80 and 82 are the same or similar in structure. Also, preferably, the dispensers 46, 68, 76, 82 and 86 are the same or similar in structure.

Each of the ESVs 49, 50, 52, 54 and 56 is postioned intermediate the ROS and the developer roll of the developer housing structure with which it is associated, as shown at the development stations.

The composite image developed on the photoreceptor belt 24 consists of both high and low charged toner particles, therefore a pre-transfer corona discharge member 88 is provided to condition all of the toner to the proper charge level for effective transfer to a substrate 90 using a corona discharge device exhibiting a predetermined discharge of the desired polarity.

Subsequent to image development, a sheet of support material 90 is moved into contact with the toner images at transfer station H. The sheet of substrate material 90 is advanced to transfer station H from a supply unit 92 in the direction of arrow 94. The sheet of support material 90 is then brought into contact with photoconductive surface of photoreceptor belt 24 in a timed sequence so that the toner powder image developed thereon contacts the advancing sheet of support material 90 at transfer station H.

Transfer station H includes a transfer corona discharge device 96 for spraying ions onto the backside of support material 90. The polarity of these ions is opposite to the polarity of that exhibited by the pretransfer corona discharge device 88. Thus, the charged toner powder particles forming the developed images on the photoreceptor belt 24 are attracted to sheet 90. A detack dicorotron 98 is provided for facilitating stripping of the sheets from the photoreceptor belt 24 as the belt moves over the roller 32.

After transfer, the sheet of support material 90 continues to move onto a conveyor (not shown) that advances the sheet to the fusing station. The fusing station includes a heat and pressure fuser assembly, indicated generally by the reference numeral 100, that permanently affixes the transferred powder image to sheet 90. Preferably, fuser assembly 100 comprises a heated fuser roller 102 and a backup or pressure roller 104. Sheet 90 passes between fuser roller 102 and backup roller 104 with the toner powder images contacting fuser roller 102. In this manner, the toner powder images are permanently affixed to sheet 90. After fusing, a chute, not shown, guides the advancing sheets 90 to a catch tray, stacker, finisher or other output device (not shown), for subsequent removal from the printing machine by the operator.

After the sheet of support material 90 is separated from photoconductive surface of photoreceptor belt 24, the residual toner particles remaining on the photoconductive surface after transfer are removed therefrom. These particles are removed at cleaning station using a cleaning brush or plural brush structure contained in a cleaner housing structure 106. The cleaner housing structure contains a plurality of brushes 108 that contact the photoreceptor for removal of residual toner therefrom after the toner images have been transferred to a sheet or substrate 90.

Controller 18 regulates the various printer functions. The controller 18 preferably includes one or more programmable controllers, that control printer functions hereinbefore described. The controller 18 may also provide a comparison count of the copy sheets, the number of documents being recirculated, the number of copy sheets selected by the operator, time delays, jam corrections, etc. The control of many of the xerographic systems heretofore described may be accomplished automatically or through the use of a user interface of the printing machine consoles selected by an operator. Conventional sheet path sensors or switches may be utilized to keep track of the position of the document and the copy sheets.

Figure 2:
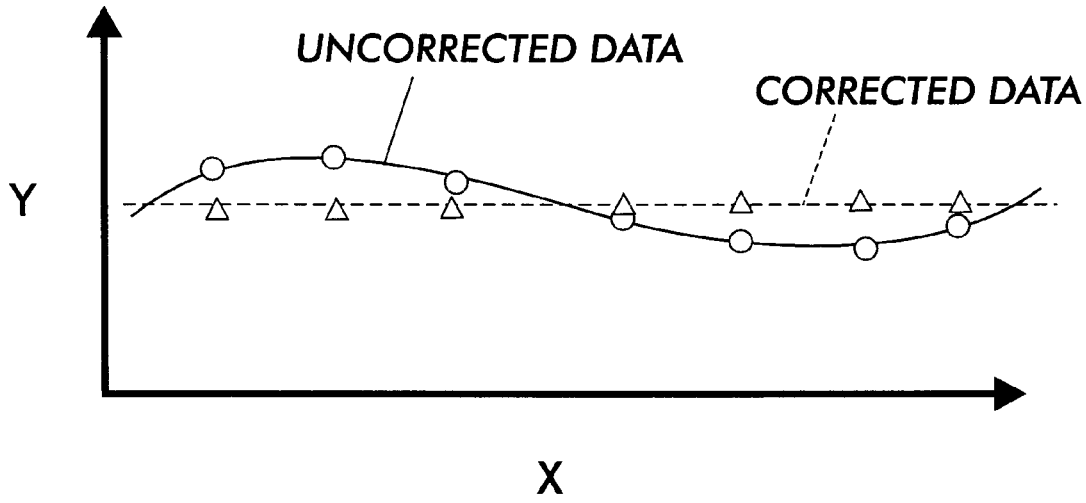
FIG. 2 illustrates plots of voltage photoreceptor position for the once-around of the photoreceptor showing uncorrected signature data and for corrected data illustrating the constant aspect of the corrected data.
Figure 3:
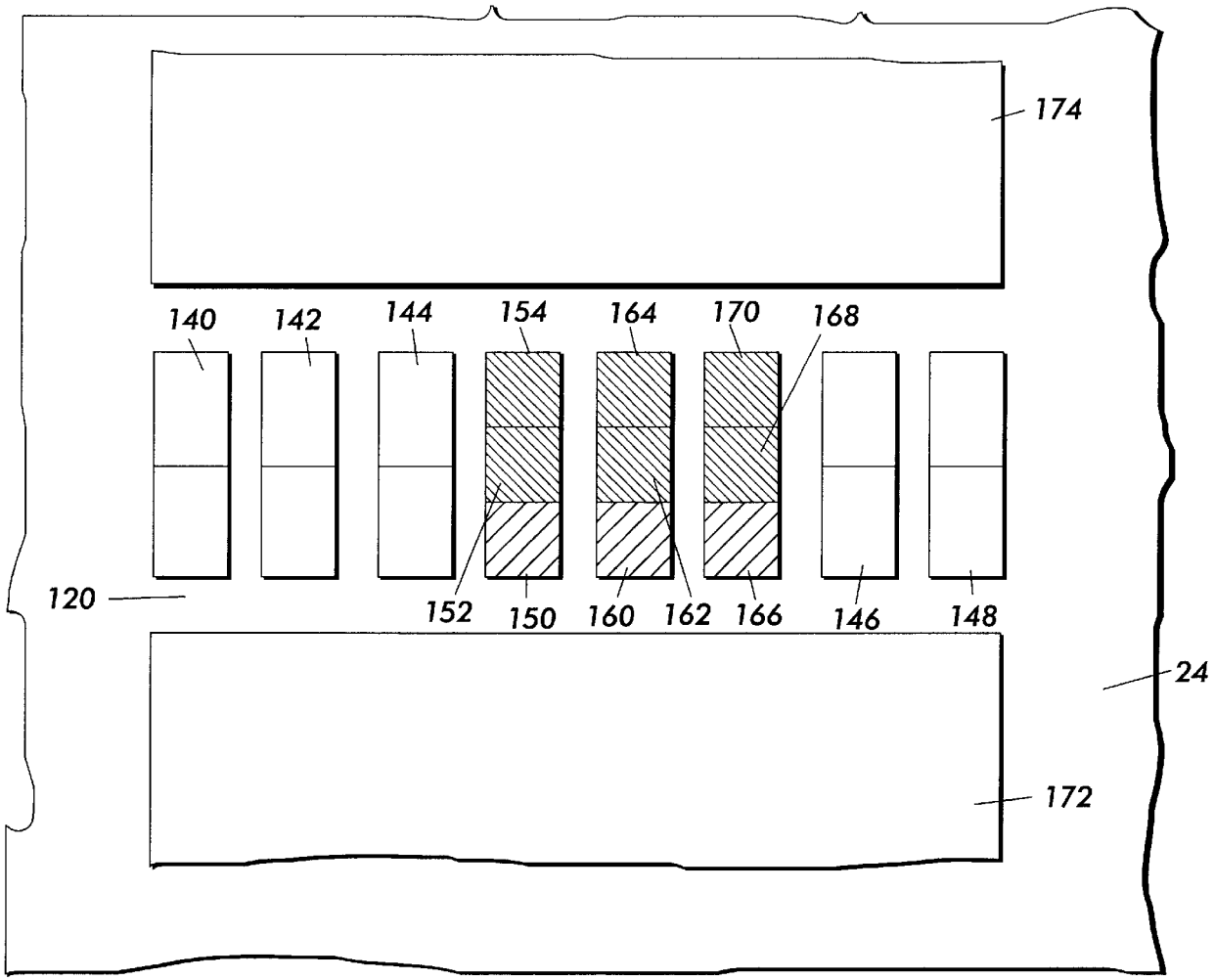
FIG. 3 depicts ESV and ETACS control patches that are formed in the IPZ of the photoreceptor.

As is the case in of all print engines of the type disclosed, the photoreceptor 24 contains a plurality of InterPage Zone (IPZ) frames 120 (FIG. 2). IPZ refers to the space between successive customer images formed on the photoreceptor 24. Each IPZ contains patches to be read by the five ESVs 49, 50, 52, 54 and 56 and three ETACS 122, 124 and 126. The ETACS are positioned downstream of the last developer structure 82 and upstream of the pretransfer corona device 88.

Figure 4:
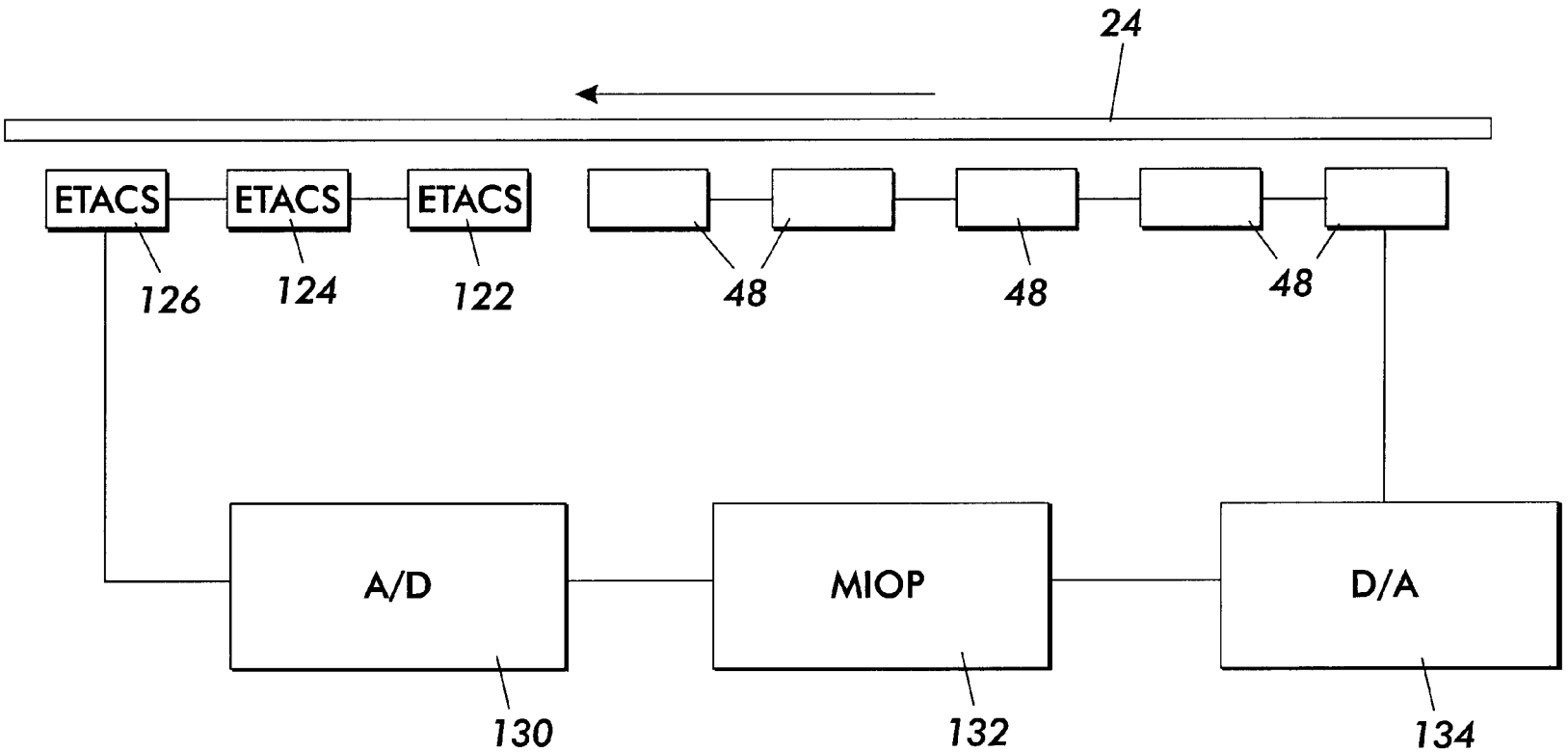
FIG. 4 is a schematic diagram of a control for the corona charging devices of the disclosed machine.

Readings made by the ETACS are converted, using an Analog to Digital (A/D) converter 130, to digital information for use through software algorithms resident in a Master Input Output Processor or controller, MIOP 132 (see FIG. 4). Outputs from the MIOP are converted to analog signal information via a Digital to Analog (D/A) converter 134 for use in controlling, by way of example, the corona discharge devices 36 and 48. The needed range of charge potentials on the photoreceptor is approximately 0–1300 volts output for a 0 to 5 volts analog input to the scorotron and dicorotron power supplies. A 10 bit D/A will give about 1.25 volt/step resolution. Suitable target values are stored in Non Volatile Memory forming a part of the MIOP. The electrostatic control algorithm will consist of a proportional-integral feedback loop with anti-windup that adjusts the AC scorotron grid voltage based on the measured error between the ESV readings and the charge target.

The DC dicorotron grid voltage is set using the AC scorotron grid voltage plus a split voltage between the two grids. The split voltage is established during a setup routine where the actual voltage on the photoreceptor is measured using each device separately. A desired split voltage on the photoreceptor is an NVM value and the difference between the two grid voltages is set to achieve this target.

A set of inner and outer limits is defined around the charge target. Readings inside the inner limit are used to declare the charge controls "converged," allowing subsequent ETACS readings to be acquired. Failure to converge charge within a fixed number of attempts will result in a system fault.

Readings outside the outer limits will be used to suspend the customer's job and send the print engine into a dead cycle mode to converge charge as quickly as possible. Exceeding the outer limit when the AC scorotron grid is at its operational limit will result in a system fault.

The use of a hierarchical control strategy isolates subsystem controls thereby enabling efficient algorithm design analysis and implementation for the algorithms forming a part of the MIOP. It will be appreciated that while only the level 1 $V_c$ controller for the corona charging devices has been described, other controllers are utilized for Level 1 subsystems. Other Level 1 controllers may include any or all of the following controllers: a charging controller, a laser power controller, a toner concentration controller, a transfer efficiency controller, a fuser temperature controller, a cleaning controller, a decurler controller and a fuser stripper controller.

To control the marking engine of a particular IOT to maintain a desired TRC, the hierarchical controls strategy of the architecture of the disclosed machine is divided into two additional levels of controllers, Level 2 and Level 3. Each of the controllers in the three levels comprises a sensor, a controller algorithm and an actuator (see the flow diagram on page 17) which adjusts the process being controlled by the controller in response to a sensed parameter. The Level 1 controllers stabilize the individual process steps of forming an image locally by using data output from a single sensor provided for each Level 1 subsystem and directly adjusting an actuator for each of the Level 1 subsystems. Level 2 controllers provide regional rather than local control of intermediate process outputs. Level 2 controllers receive a set of scalar values from the Level 1 controllers in addition to sensor readings of the intermediate process output being controlled. Actuation in Level 2 occurs on an algorithm parameter of a Level 1 controller (usually a setpoint). That is, Level 2 actuates or adjusts based on a sensor output by changing at least one parameter for at least one Level 1 controller. Levels 1 and 2 adjust the physical components and processes involved in outputting an image in order to achieve TRC stabilization at a small number of discrete points. In between these points on the TRC, stabilization is achieved by the Level 3 controller which measures the output of the total system and adjusts the interpretation of the image at the input to the process.

Each frame or IPZ contains two untoned or undeveloped patch areas for use with each of the five ESVs and three toned or developed patch areas for use with each of the three ETACS for a total of nineteen patches. The untoned and undeveloped ESV patches consist of two patches 140 for black, two patches 142 for cyan, two patches 144 for yellow, two patches 146 for magenta and two patches 148 for the spot color.

By way of example, toned patches to be sensed by the ETACS may comprise one set of three patches comprising a toned patch 150 consisting of only yellow toner and two toned complementary patches 152 and 154 consisting of a blue (magenta plus cyan) patch and dark spot (black plus spot) patch, respectively. A second set of three toned patches may comprise a patch 160 consisting of magenta toner and a pair of toned complementary patches comprising a green (cyan plus yellow) patch 162 and a dark spot (black plus spot) patch 164. The third set of three patches may comprise a patch 166 consisting of cyan toner and a pair of complementary patches comprising a red (magenta plus yellow) patch 168 and a dark spot (black plus spot) patch 170. The patches are disposed in IPZs 120 intermediate full color image areas 172 and 174.

The content of the separate patch areas, illustrated in FIG. 2, by way of example, will change in successive IPZs, according to a runtime patch scheduler algorithm forming a part of the MIOP. The placement of the patches within each IPZ remains fixed following autosetup of the imaging processor. Each IPZ frame is approximately 43 mm long, that is the distance required by each ROS to allow ample time for aligning the images in each xerographic module to each other (using a process referred to as rephasing). The ROS rephase process does not affect the control patch image structure on a scale comparable to the ETACS or ESV field of view. The number of IPZs on the photoreceptor belt structure 24 is a function of the number of images that are be placed on the belt during one pass of the belt through all of the process stations. The number of IPZs varies from machine to machine.

The position and size of each patch in the IPZ is established by a diagnostic timing routine during autosetup. The patches for each sensor are placed according to the field of view of each sensor, determined by the physical mounting dimensions for each sensor as well as internal dimensions for the sensing elements within each sensor. This process allows for minimum control patch sizes and, correspondingly, minimal toner waste.

A hierarchical control strategy is one that isolates subsystem controls for purposes of efficient algorithm design, analysis and implementation. The strategy and architecture support therefor is preferably divided into three levels (i.e. 1, 2 and 3) and has a controls supervisor that provides subsystem isolation functions and reliability assurance functions. The strategy improves image quality of an Image Output Terminal, IOT outputs by controlling the operation of the IOT to ensure that a toner reproduction curve of an output image matches a tone reproduction curve of an input image, despite several uncontrollable variables that change the tone reproduction curve of the output image. For a more detailed description of a hierarchical control strategy, reference may be had to U.S. Pat. No. 5,471,313, incorporated herein by reference, granted to Tracy E. Thieret et al on Nov. 28, 1995.

The first step in implementing the present invention is the measuring of the $V_c$ belt signature. The purposes of belt signature measurements are twofold—(1) to characterize the magnitude of these effects for the purpose of system diagnostics and (2) to minimize their impact on the system's process controls performance.

The first purpose is achieved by measuring the belt signatures during diagnostics for setup and Print Quality Adjustment (PQA) to establish a baseline and checking it prior to the start of a customer's print job. Unacceptable variation leads to a fault and a message to the customer via a display panel (not shown) to run a PQA, or to the service rep to repair the system, usually by changing the photoreceptor. The second purpose is achieved by removing the variation from subsequent process controls sensor readings. If one considers the process controls to control within a certain limit around the sensor readings, it is clearly better to have the band centered around the average performance of the system rather than follow the once-around profile.

Measurement of the Vc belt control signature is accomplished as follows:

1. Inputs are made by continuously sampling a requested sensor/channel (ESV#)/every 20 machine clocks (3.1 mm of photoreceptor surface) around the photoreceptor from seam to seam. A total of 934 readings are taken.
2. The aforementioned 41-element, weighted average filter is used to smooth the readings. The filter coefficients are tabulated below. The average voltage is determined and a LookUp (LUT) table is constructed in the MIOP with the delta voltage from average vs. around the photoreceptor. For all subsequent readings under electrostatic control, ESV continuous Vc readings are corrected for the deviation from average around the photoreceptor.

| j | n | j | n | j | n |
|---|---|---|---|---|---|
| −20 | 1 | −6 | 600 | 8 | 439 |
| −19 | 4 | −5 | 676 | 9 | 360 |
| −18 | 10 | −4 | 745 | 10 | 286 |
| −17 | 20 | −3 | 804 | 11 | 220 |
| −16 | 35 | −2 | 850 | 12 | 165 |
| −15 | 56 | −1 | 880 | 13 | 120 |
| −14 | 84 | 0 | 891 | 14 | 84 |
| −13 | 120 | 1 | 880 | 15 | 56 |
| −12 | 165 | 2 | 850 | 16 | 35 |
| −11 | 220 | 3 | 804 | 17 | 20 |
| −10 | 286 | 4 | 745 | 18 | 10 |
| −9 | 360 | 5 | 676 | 19 | 4 |
| −8 | 439 | 6 | 600 | 20 | 1 |
| −7 | 520 | 7 | 520 | | |

Using the values listed in the table above, the filtered value is calculated according to the following formula:

For I=21 through 914:

$$\text{Filtered}(i) = \frac{\left[\sum_{j=-20}^{20} n(j)\text{Read}(i+j)\right]}{14641}$$

3. The average is then calculated according to the formula:

$$\text{Average} = \frac{\sum_{i=21}^{914} \text{Read}(i+j)}{894}$$

4. The missing Filtered elements are filled in:
   For i=1 to 20
      Filtered i=Filtered(21)
   for I=915 to 934
      Filtered i=Filtered 914
5. At each cycle up prior to printing a customer's job the belt signature is measured and compared to the current signature table. A significant deviation results in a fault declaration to be followed by a PQA where the signature will be recharacterized. Filtered values are tested to determine if they are too far from average as follows:
   If
      minimum (Filtered)<Average−MaxDelta
      OR maximum(Filtered >Average+MaxDelta
   Then
      declare a fault and run a PQA to recharacterize the photoreceptor
   Else
      proceed with the customer's job
   Runtime Control—Using the Table:

For all ESV Vcharge readings scheduled by the MIOP, determine the proper index i based on the location of the readings with respect to the seam and correct the charge readings taken by the ESV.

Master Process Control Switch If the $V_c$ belt signature Master Process Control Switch is on, all $V_c$ IPZ readings are corrected.

If the $V_c$ belt signature Master Process Control Switch is off, no $V_c$ IPZ readings are corrected.

3. Determine the index I
   I=Round(ESV Vcharge Machine Clock Location/20)
   where the machine clock location equals the center of the charge patch.
2. Correct the charge reading
   Vcharge#=ESV Vcharge reading#−Delta# (I)
3. Save the reading in NVM (VcMeasured#) and use the corrected reading in the charge control algorithm.

What is claimed is:

1. Image creation apparatus, said apparatus comprising:

a circulating charge retentive surface;

means for uniformly charging said charge retentive surface;

means for selectively discharging said charge retentive for forming latent images thereon;

means for rendering said latent images visible;

means for controlling systems processes such as said means for uniformly charging said charge retentive surface;

means for sensing the once-around voltage signature of said charge retentive surface during apparatus setup in order to characterize the magnitude of the effects of manufacturing variances for the purpose of system diagnostics; and means for minimizing said effects' impact on the performance of said systems processes, said means for minimizing being effected only during apparatus runtime.

2. The image creation apparatus according to claim 1 wherein said minimizing means comprises means for averaging voltages of said once-around signature to determine a mean value for use in correction of said voltages prior to their use in operation of said means for uniformly charging said charge retentive surface.

3. The image creation apparatus according to claim 2 including means for smoothing deviations from mean values are smoothed using a symmetric 41-term (or similar) weighting function that removes the high frequency reading spikes while retaining the low frequency signature.

4. The image creation apparatus according to claim 3 wherein said symmetric 41-term (or similar) weighting function uses a measured voltage on said charge retentive surface and twenty (or equal) readings before and after said measured voltage to avoid phase shifts between the actual and filtered low frequency signature.

5. The image creation apparatus according to claim 4 wherein said charge retentive surface comprises a photoreceptor belt structure.

6. The image creation apparatus according to claim 5 wherein said measurement of said once-around signature is effected every 3 mm around the periphery of said photoreceptor belt having seam where ends of the photoreceptor are joined together.

7. The image creation apparatus according to claim 6 wherein a table is constructed with a delta voltage from average versus position around the photoreceptor for use in properly controlling the output of said means for uniformly charging said photoreceptor.

8. The image creation apparatus according to claim 7 wherein measurement of said once-around signature is commenced a few mm past said seam and terminated a few mm prior to said seam.

9. The image creation apparatus according to claim 4 wherein a signature table is constructed with a delta voltage from average versus position around the photoreceptor for use in properly controlling the output of said means for uniformly charging said photoreceptor.

10. The image creation apparatus according to claim 9 said wherein said belt signature is measured prior to running a customer's print job and compared to the current signature table and wherein a fault is declared when a significant deviation therebetween is determined.

11. In a toner image processing machine including controllers, a charge retentive imaging surface, a plurality of sensors, and charging members for depositing charges on said charge retentive surface a method of correcting the once-around noise effects of a photoreceptor, said method including the steps of:

sensing the once-around voltage signature of said charge retentive surface during machine setup;

characterizing the magnitude of the effects of manufacturing variances for the purpose of system diagnostics; and minimizing only during machine runtime said effects' impact on the performance of systems processes.

12. The method of correcting the once-around noise effects according to claim 11 wherein said step of minimizing comprises averaging voltages of said once-around signature to determine a mean value for use in correction of said voltages prior to their use in operation of said means for uniformly charging said charge retentive surface.

13. The method of correcting the once-around noise effects according to claim 12 including the step of smoothing deviations from mean values using a symmetric 41-term (or similar) weighting function that removes the high frequency reading spikes while retaining the low frequency belt signature.

14. The method of correcting the once-around noise effects according to claim 13 said step of smoothing deviations from mean values uses a measured voltage on said charge retentive surface and twenty (or equal) readings before and after said measured voltage.

15. The method of correcting the once-around noise effects according to claim 14 wherein said step of measuring the once-around effect is measured said effect on a belt structure.

16. The method of correcting the once-around noise effects according to claim 15 wherein said measurement of said once-around signature is effected every 3 mm around the periphery of said photoreceptor belt having seam where ends of the photoreceptor are joined together.

17. The method of correcting the once-around noise effects according to claim 16 including the step of creating a table constructed with a delta voltage from average versus position around the photoreceptor for use in properly controlling the output of said means for uniformly charging said photoreceptor.

18. The method of correcting the once-around noise effects according to claim 17 wherein measurement of said once-around signature is commenced a few mm past said seam and terminated a few mm prior to said seam.

19. The method of correcting the once-around noise effects according to claim 14 wherein a signature table is constructed with a delta voltage from average versus position around the photoreceptor for use in properly controlling the output of said means for uniformly charging said photoreceptor.

20. The method of correcting the once-around noise effects according to claim 19 said step of measuring said belt signature is effected each time prior to running a customer's print job.

* * * * *